US007303310B2

(12) United States Patent
You et al.

(10) Patent No.: US 7,303,310 B2
(45) Date of Patent: Dec. 4, 2007

(54) STRUCTURE FOR A HIGH EFFICIENCY AND WATER-PROOF LIGHTING DEVICE

(75) Inventors: Ju-Yuan You, HsinChu (TW); Chien-Liang Yeh, HsinChu (TW); Zong-Huai Lee, HsinChu (TW); Chien-Feng Chang, HsinChu (TW); Chan-Peng Lin, HsinChu (TW)

(73) Assignee: Opto Tech Corp., Hsinchu (TW)

( * ) Notice: Subject to any disclaimer, the term of this patent is extended or adjusted under 35 U.S.C. 154(b) by 34 days.

(21) Appl. No.: 11/277,233

(22) Filed: Mar. 23, 2006

(65) Prior Publication Data

US 2007/0223218 A1 Sep. 27, 2007

(51) Int. Cl.
*F21V 31/00* (2006.01)

(52) U.S. Cl. ..... 362/240; 362/219; 362/222; 362/225; 362/555

(58) Field of Classification Search ..... 362/219, 362/222, 224, 225, 231, 260, 240, 248, 555, 362/800
See application file for complete search history.

(56) References Cited

U.S. PATENT DOCUMENTS 5,950,340 A * 9/1999 Woo ..... 40/564
6,659,623 B2 * 12/2003 Friend ..... 362/249
7,192,161 B1 * 3/2007 Cleaver et al. ..... 362/260
2003/0021115 A1 * 1/2003 Sloan et al. ..... 362/240
2003/0048641 A1 * 3/2003 Alexanderson et al. ..... 362/470
2006/0023466 A1 * 2/2006 Tsai ..... 362/541

* cited by examiner

*Primary Examiner*—Sandra O'Shea
*Assistant Examiner*—Mary Zettl

(57) ABSTRACT

A structure for a high diffuse efficiency and water-proof lighting device is provided, including a light tube and a base holder. The light tube and the base holder are each an enclosed structure. The light tube includes a circuit substrate inside the enclosed structure. The circuit substrate includes a plurality of LEDs. The light tube and the base holder each include two holes close to both ends. When the light tube and the base holder are assembled, the holes match so that the wire connecting the circuit substrate can go through the holes to enter the base holder. A water-proof and highly pull-resistant glue is used to fill the overlapping of the holes. A resilient element is used to connect the neighboring circuit substrates, the resilient element can absorb the deformation caused by the temperature changes so that the light diffusion remains uniform. Therefore, the lighting device can perform well even when operating in an environment with drastic temperature changes.

13 Claims, 6 Drawing Sheets

STRUCTURE FOR A HIGH EFFICIENCY AND WATER-PROOF LIGHTING DEVICE

FIELD OF THE INVENTION

The present invention generally relates to a full-color LED lighting device, and more specifically to a high efficiency and water-proof structure of a full-color LED lighting device.

BACKGROUND OF THE INVENTION

As the modern demands in living environment, the lighting is playing an even more important role than ever. Nowadays, the lights are no longer for illuminations for people to see in the dark, lights are also used in creating certain atmosphere and are becoming part of an architecture or art design. However, as the energy resource is becoming scarce, the energy consumption also becomes an important concern when using lights. The recent development of LED has brought about the revolutionary changes in the lighting devices. The LED lighting devices can be directly controlled by a computer program for changing the color, the intensity and the ON/OFF interval to display full color ranges. This is more visually appealing than the conventional neon-light devices. An additional benefit of using LED lighting devices is that the energy consumption is lower than the conventional neon-light devices.

As many LED lighting devices are used outdoors, such as sport venues or the outer wall of a building, it is imperative that the device is water-proof. FIG. 1 shows a schematic view of the partial structure of a conventional LED light device, including a light shade 11, a circuit board 12 with a plurality of LEDs 13, and a base holder 14. Light shade 11 is engaged to the top of base holder 14, and the connecting part is sealed with water-proof glue. Both sides of light shade 11 and base holder 14 include a top side cover 15 and a bottom side cover 16 that the interior space is completely sealed to prevent the water from coming in. However, this type of structure has the following drawbacks:

1. The water resistance is poor in an environment where the temperature experiences significant changes. Because this type of lighting device is usually longer than 1 meter, and mainly comprises a light shade, a circuit board and a base holder, all of them made of different materials. Therefore, the thermal expansion coefficients of these three major components may be very different from one another. For example, a base holder is usually made of aluminum, and the light shade may be made of acrylic. In an environment where the summer temperature can reach as high as 30-40° C., and the winter can be as cold as −5-20° C., the deformation of these components can be very different due to different thermal expansion coefficients, such as expansion or shrinkage. As a result, the tight seal between the light shade and the base holder can be broken and leads to water leakage.
2. The manufacturing process is complicated and time-consuming. In addition to installing the circuit board to the base board and connecting the LEDs, the water-proof glue must be applied to the connection between the base holder and the light shade, which may be longer than 1 meter. As a result, the yield rate is poor if additional caution is not taken during the sealing process.

SUMMARY OF THE INVENTION

The present invention has been made to overcome the above-mentioned drawback of conventional LED lighting devices. The primary object of the present invention is to provide a water-proof LED lighting device. The main components of the lighting device are all separately enclosed objects so that the components will not interfere with each other when the components expand or shrink due to the temperature changes. Also, the electrical connection between the two components is glued with an enhanced water-proof glue that can stand strong pull. On one hand, the glue is soft as to absorb the deformation due the temperature changes. On the other hand, the glue provides water-proof connection. Therefore, the present invention is still highly water-proof in an environment that encompasses large temperature changes. In addition, the present design simplifies the structure so that the assembly of the components is easier. With the multiple water-proof mechanisms, the lighting device of the present invention is highly water-proof.

Another object of the present invention is to provide a high efficiency LED lighting device. A highly-diffuse material, such as special acrylic, is used to enable the lights emitted from different LEDs to be uniformly diffused. When observing from the outside, the present invention shows a uniformly mixed single color at a time With the control of a computer program, the light color of the present invention can display the full range of colors to achieve the same visual effects of a neon-light. In addition, as a resilient element is used to connect the neighboring circuit substrate, the resilient element can absorb the deformation caused by the temperature changes so that the light diffusion remains uniform.

To achieve the above objects, the present invention provides a lighting device, including a light tube and a base holder. The light tube and the base holder are each an enclosed structure. The light tube includes a circuit substrate inside the enclosed structure. The circuit substrate includes a plurality of LEDs. The light tube and the base holder each include two holes close to both ends. When the light tube and the base holder are assembled, the holes match so that the wire connecting the circuit substrate can go through the holes to enter the base holder. A water-proof and highly pull-resistant glue is used to fill the overlapping of the holes. When the light tube and the base holder expand or shrink differently due to the temperature changes, the glue will absorb the discrepancy of the deformation to sustain the structure.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

Figure 1:
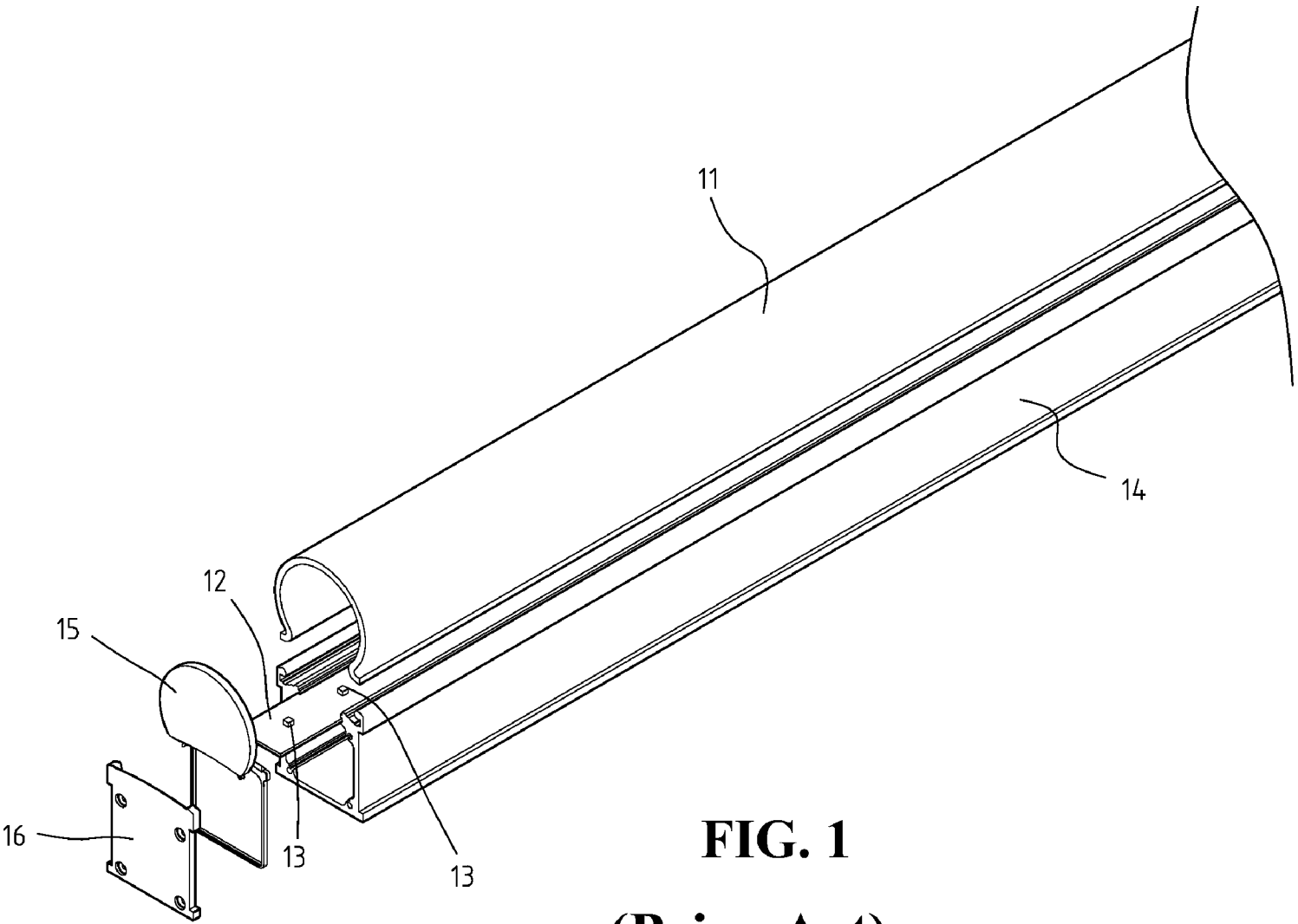
FIG. 1 (Prior Art)
FIG. 1 shows a partial exploded view of a conventional LED lighting device.
Figure 2:
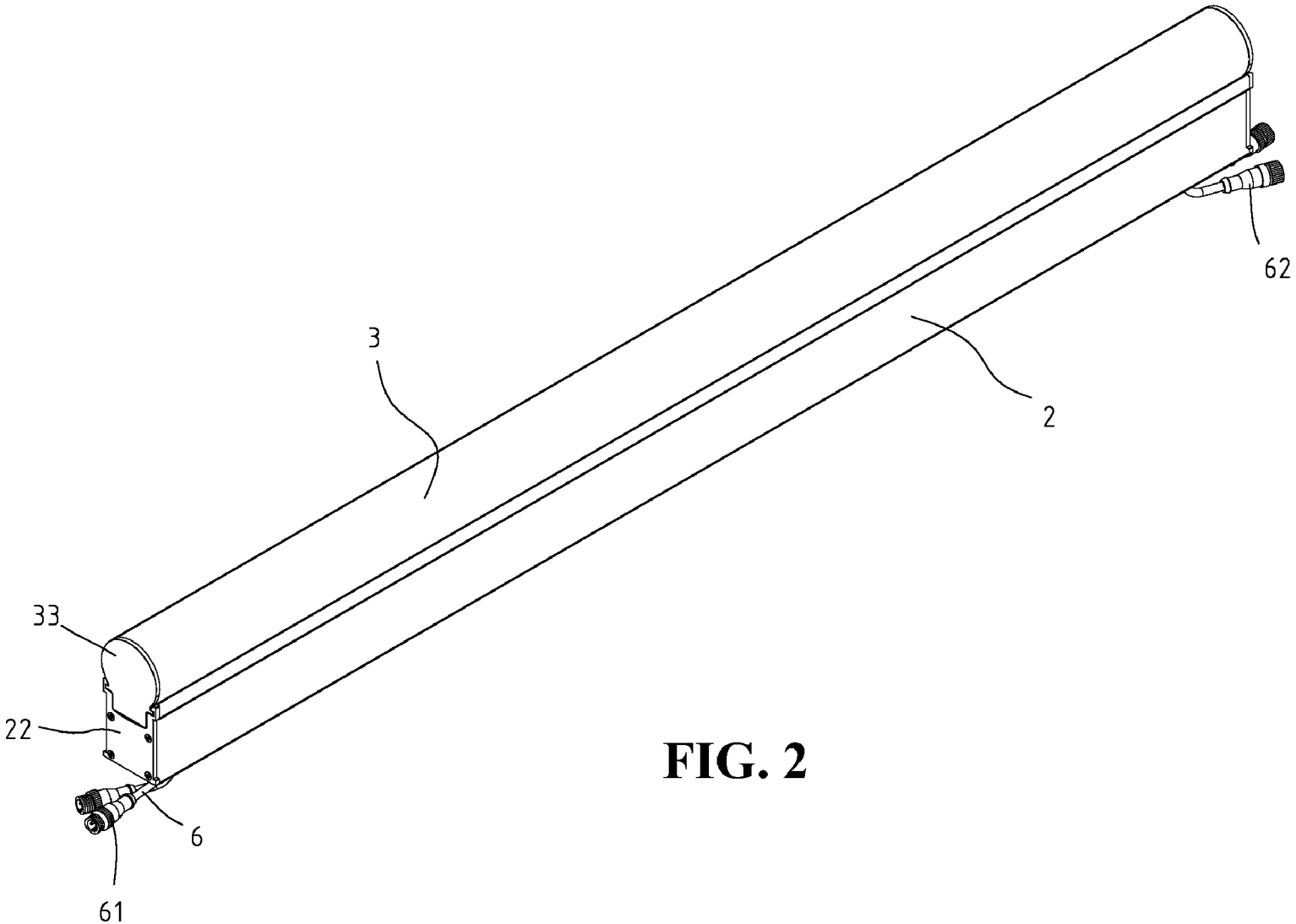
FIG. 2 shows a schematic view of the present invention.
Figure 3:
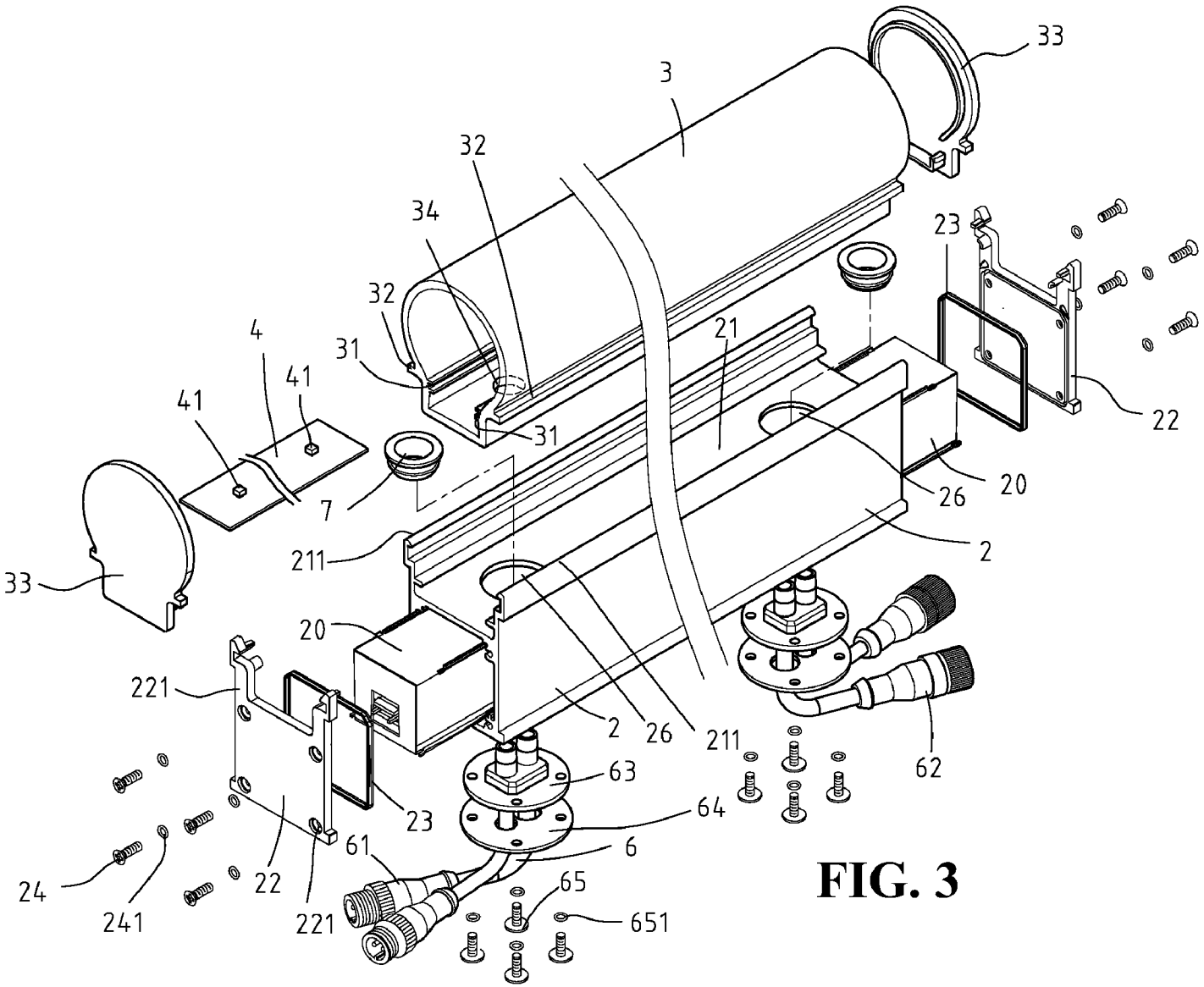
FIG. 3 shows an enlarged exploded view of the present invention.

FIGS. 2 & 3 show the three-dimensional and exploded view of the present invention. The present invention includes a base holder 2 and a light tube 3. Light tube 3 is engaged to base holder 2 from the top. Light tube 3 includes at least a circuit substrate 4. Circuit substrate 4 is enclosed inside light tube 3. Each circuit substrate 4 includes a plurality of LED units 41. Each LED unit 41 includes one or more red, green, and blue LEDs, so that each LED unit 41 can provide full color light.

As shown in FIG. 3, a guiding trench 31 is included inside light tube 3. Guiding trench 31 is located on the facing side walls of light tube 3. Circuit substrate 4 is inserted to guiding trench 31 so that the vertical location of circuit substrate 4 is fixed.

Figure 4:
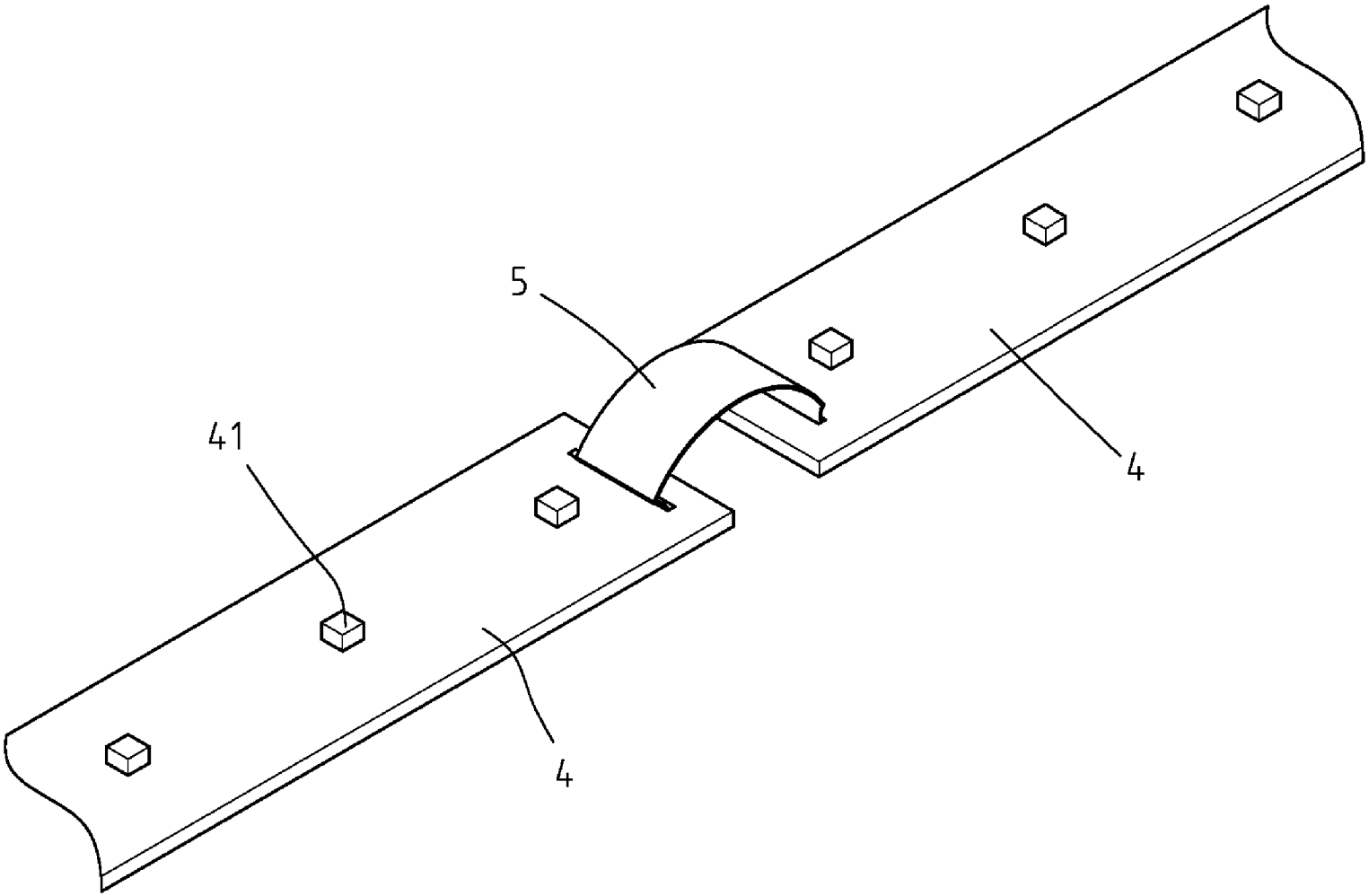
FIG. 4 shows the connection of the circuit substrates of the present invention.

FIG. 4 shows another embodiment of a plurality of circuit substrates 4 when light tube 3 is sufficient longer to accommodate more circuit substrates 4. A resilient arc element 5 is used to connect two neighboring circuit substrates 4. Resilient element 5 is to maintain the distance between two neighboring circuit substrates 4. When the environmental temperature changes, light tube 3 may expand or shrink. Circuit substrate 4 may also expand or shrink to a different extent. Therefore, by using resilient element 5 to absorb the possible discrepancy caused the deformation and maintaining the distance between circuit substrates 4, the distribution of light along light tube 3 can stay uniform. This avoids the dark areas on light tube 3 when light tube 3 expands, or circuit substrates damages when light tube 3 shrinks.

The top of base holder 2 includes a receiving trench 21 corresponding to the outer surface of light tube 3 so that light tube 3 can be engaged to receiving trench 21. An additional glue can be applied to enhance the engagement. The receiving trench 21 of base holder 2 has two vertical side walls that are formed with two engaging ribs 211. The bottom of light tube 3 includes two extruding ribs 32. Light tube 3 is inserted onto base holder 2 from the lateral direction. Extruding ribs 32 of light tube 3 are positioned against the engaging ribs 211 of base holder 2 to prevent light tube 3 from moving vertically. This also simplifies the assembly of the present invention.

To achieve good water-proof effect, the present invention provides design between components, described as follows. Light tube 3 is a hollow tube, made of highly diffuse acrylic so that the lights emitted from LEDs can be uniformly diffused to the tube. Although a plurality of LEDs with different colors is included inside the tube, the tube shows only a uniform single color when lit and observed from outside of the tube. This is because the tube is made of highly diffuse material that is able to diffuse the lights. Each end of light tube 3 includes a top side cover 33. Top side cover 33 is made of the same high diffuse acrylic that light tube 3 is made of. An acrylic glue can be applied to melt light tube 3 and top side cover 33 so that the engagement between the two is enhanced and water-proof. Because light tube 3, top side cover 33 and the sealing acrylic glue are made of the same material, they have the same thermal expansion coefficients. In addition, the bottom of light tube 3 includes two holes 34, with each hole 34 close to the end. The wire connecting the circuit substrates enters from hole 34.

Base holder 2 is a hollow, long square tube. Inside base holder 2 is at least a transformer 20. The number of transformers 20 depends on the number of the LEDs and the number of circuit substrates 4. This embodiment uses two transformers. Transformer 20 is for converting AC into DC to drive the LEDs on circuit substrates 4. In this embodiment, base holder 2 is made of aluminum. Each end of base holder 2 includes a bottom side cover 22, also made of aluminum so that the thermal expansion coefficients are the same as base holder 2. Base holder 2 and bottom side cover 22 are engaged by a highly elastic water-proof ring 23. A conic screw 24 with a water-proof ring 241 is tightened in a screw hole 221 of bottom side cover 22 and the screw hole of base holder 2 so that water-proof ring 23 is tightly squeezed to achieve the water-proof object.

The bottom of base holder 2 needs a wire to connect with the power supply or the control computer. This embodiment uses a connecting wire 6 with a water-proof connector 61. Connecting wire 6 enters a hole 25 (see FIG. 5) at the bottom of base holder 2. Connecting wire 6 is connected to transformer 20 and circuit substrate 4, respectively. In this embodiment, water-proof connector 61 at the front and water-proof connector 62 at the back are designed to be able to connect with each other. With connectors 61, 62, the present invention can be connected in series to create longer lighting device. Connecting wire 6 is covered with a highly elastic water-proof plate 63. Water-proof plate 63 is covered with a presser 64. A screw 65 with a water-proof ring 652 is used to tighten presser 64 and the bottom of base holder 2.

Figure 5:
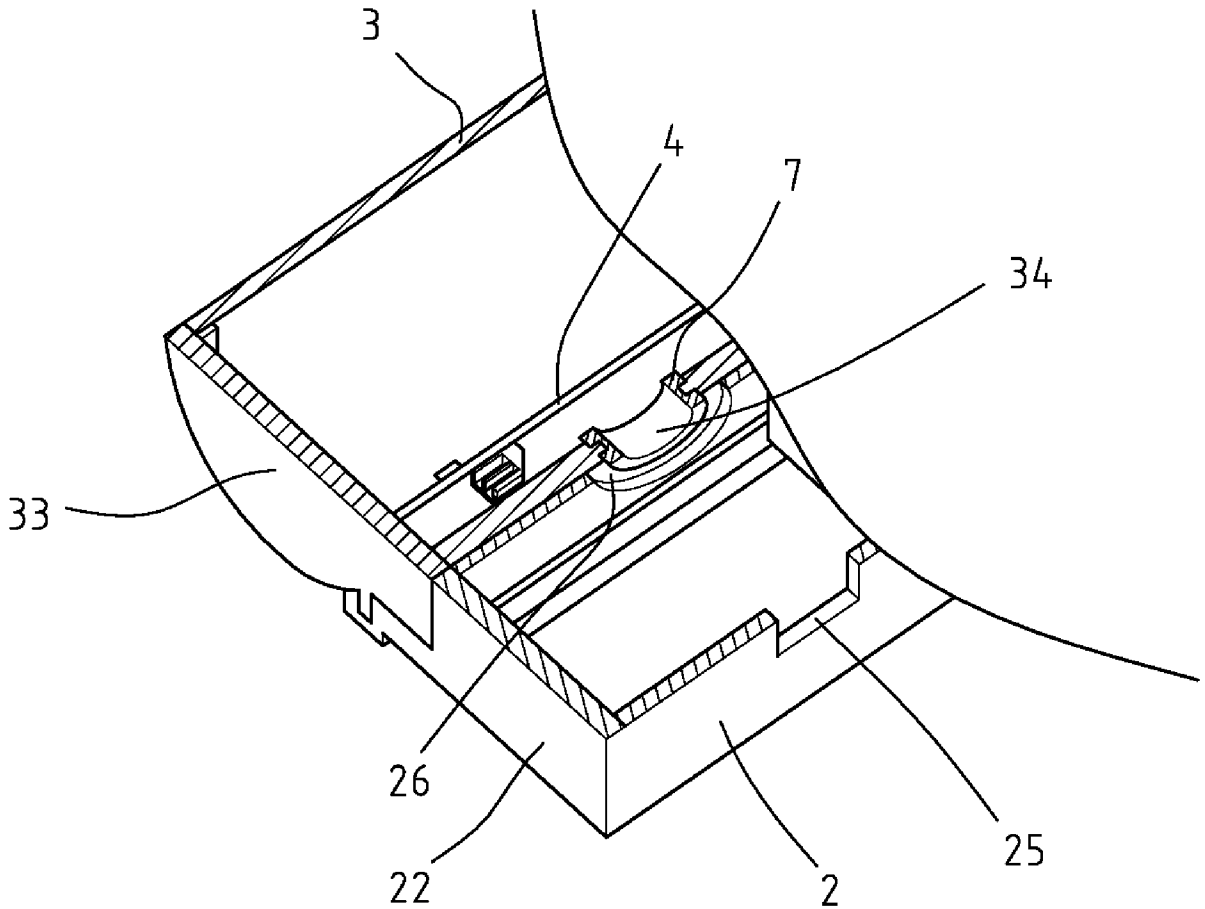
FIG. 5 shows an enlarged partial cross-sectional view of the present invention prior to applying water-proof glue.
Figure 6:
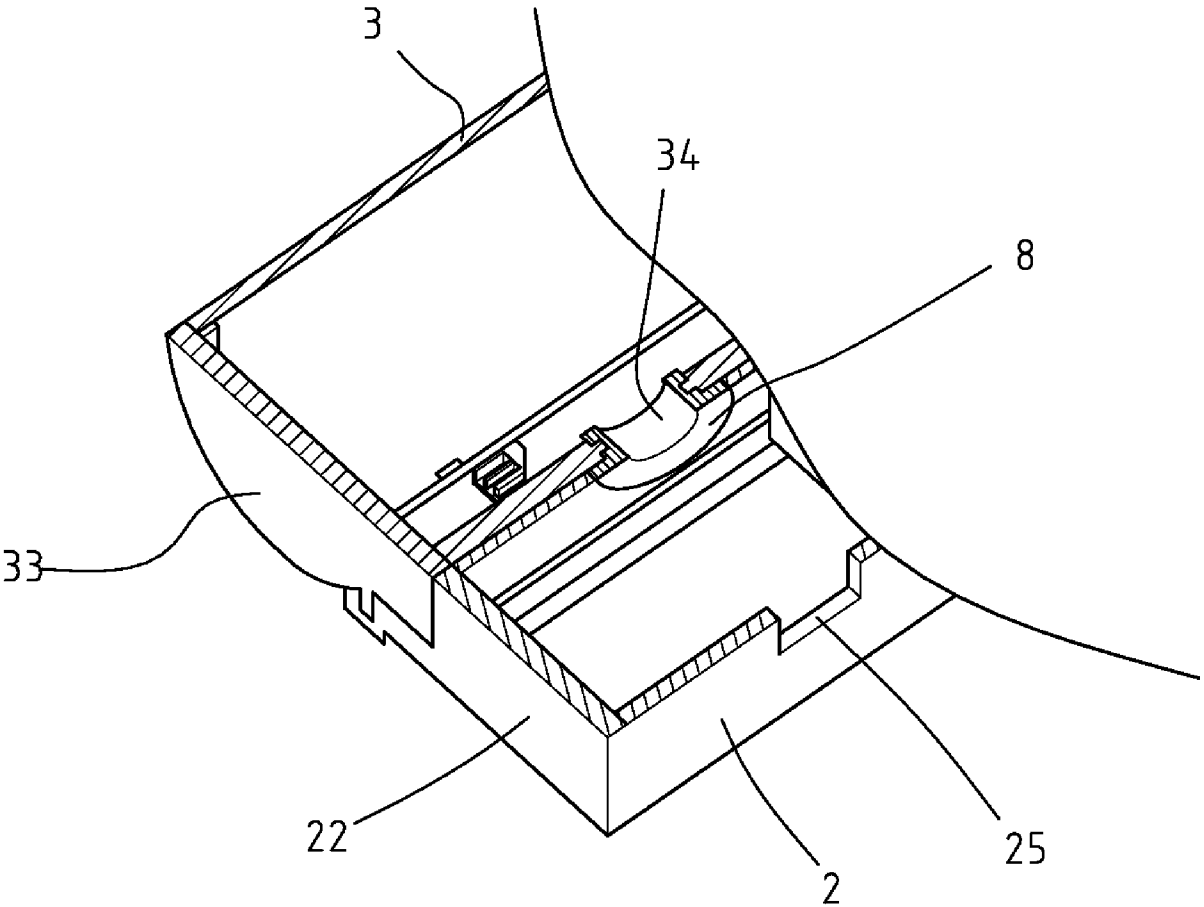
FIG. 6 shows an enlarged partial cross-sectional view of the present invention after water-proof glue applied.

As shown in the above description, light tube 3 and base holder 2 are each a separate and enclosed structure. The advantage of this design is that no leakage will happen due to the deformation caused by the temperature changes. However, there must exist a path so that the wire connecting the circuit substrate can be electrically connected to transformer 20 inside the base holder. The water-proof mechanism used at the path is shown in FIG. 3. The bottom of light tube 3 includes two holes 34, with each hole 34 close to the end. The corresponding location on base holder 2 also includes a hole 26. These holes are for the wires. A water-proof glue fills the holes so that the holes will not leak. Another mechanism can also be used. As shown in FIG. 5, hole 34 is smaller than hole 36. A ring 7 is placed in hole 34. Ring 7 and aluminum base holder 2 form a glue pool for filling with high pull-resistant water-proof glue 8, as shown in FIG. 6. Because glue 8 and ring 7 are both made of silicon resin, the two become monolithic when solidified. In addition, the monolithic structure is soft to tightly fill the holes. Another advantage of this soft monolithic structure is that it also absorbs the deformation discrepancy between the light tube and the base holder caused by the temperature changes. This is important in provide water-proof protection.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A lighting device with a water-proof structure, comprising:

a hollow light tube having two opposite ends each having a top side cover, at least a circuit substrate inside said hollow light tube, and a bottom having two holes located near said two opposite ends; and a base holder located underneath and engaged with said hollow light tube, said base holder having two holes corresponding to the two holes in said hollow light tube, and a water-proof glue filling connection of the two holes in said hollow light tube and the two holes of said base holder;

wherein said base holder further has two bottom holes located near two opposite ends of said hollow light tube, a ring-shaped water-proof plate and a ring-shaped presser cover each bottom hole for wires to penetrate through, and a screw is used to tighten said ring-shaped presser to achieve water-proof.

2. The device as claimed in claim 1, wherein said hollow light tube comprises at least two circuit substrates, and two adjacent said circuit substrates are connected by a resilient element.

3. The device as claimed in claim 1, wherein said circuit substrate comprises a plurality of red, green, or blue light emitting diodes.

4. The device as claimed in claim 1, wherein said circuit substrate comprises a plurality of different red, green, or blue light emitting diodes.

5. The device as claimed in claim 1, wherein said base holder comprises a receiving trench for engaging with a lower portion of said hollow light tube.

6. The device as claimed in claim 5, wherein said base holder comprises two engaging ribs on two side walls of said receiving trench, and the lower portion of said hollow light tube comprises two extruding ribs which are positioned against said engaging ribs to prevent said hollow light tube from moving vertically.

7. The device as claimed in claim 1, wherein said hollow light tube and the two top side covers are made of a same material.

8. The device as claimed in claim 1, wherein said hollow light tube is made of acrylic which diffuses light efficiently.

9. The device as claimed in claim 1, wherein said base holder is a hollow tube with two bottom side covers to cover both ends of said base holder to form an enclosed space.

10. The device as claimed in claim 9, wherein said two bottom side covers and said base holder are made of a same material.

11. The device as claimed in claim 1, wherein said base holder is made of aluminum.

12. The device as claimed in claim 1, wherein at least a transformer is placed inside said base holder.

13. The device as claimed in claim 1, wherein each hole in said hollow light tube is smaller than the corresponding hole of said base holder, a ring is placed inside each hole in said hollow light tube and the water-proof glue is used to fill the two corresponding holes in said hollow light and said base holder so that the ring and the water-proof glue form a monolithic structure.

* * * * *